US005157449A

United States Patent [19]

Matsuno et al.

[11] Patent Number: 5,157,449

[45] Date of Patent: Oct. 20, 1992

[54] METHOD AND DEVICE FOR XEROGRAPHIC PRINTING

[75] Inventors: Junichi Matsuno, Toride; Masahiro Yamazaki, Katsuta, both of Japan

[73] Assignees: Hitachi Ltd.; Hitachi Koki Co., Ltd., both of Tokyo, Japan

[21] Appl. No.: 805,977

[22] Filed: Dec. 12, 1991

[30] Foreign Application Priority Data

Mar. 19, 1991 [JP] Japan ..... 3-054783

[51] Int. Cl.[5] ..... G03G 15/00

[52] U.S. Cl. ..... 355/317; 271/185; 355/208; 355/309

[58] Field of Search ..... 355/316, 317, 309, 208; 271/184, 185, 225-227

[56] References Cited

U.S. PATENT DOCUMENTS

| | | | |
|---|---|---|---|
| 4,310,236 | 1/1982 | Connin | 271/245 X |
| 4,391,510 | 7/1983 | Cherian | 271/245 X |
| 4,511,242 | 4/1985 | Ashbee et al. | 271/227 X |
| 4,562,485 | 12/1985 | Maeshima | 358/280 |
| 4,823,159 | 4/1989 | Yamamoto et al. | 271/249 X |
| 4,994,864 | 2/1991 | Schieck et al. | 355/317 |
| 5,016,116 | 5/1991 | Maeshima | 358/448 |
| 5,034,781 | 7/1991 | Watanabe | 355/317 |
| 5,078,384 | 1/1992 | Moore | 271/228 |

OTHER PUBLICATIONS

English Abstract of Japanese Examined Application 61-249063, Published Nov. 6, 1986.

English Translation of claim of Japanese Unexamined Application 60-123873, Published Jul. 2, 1985.

*Primary Examiner*—Richard L. Moses

*Attorney, Agent, or Firm*—Antonelli, Terry Stout & Kraus

[57] ABSTRACT

A xerographic printing method comprises the steps of: estimating, before an attitude of the work sheet is corrected, a position of work sheet which will be obtained in a direction substantially perpendicular to a work sheet feed direction after the attitude of the work sheet is corrected, determining, in accordance with the estimated position of work sheet, a position of a toner image to be formed on a toner image forming surface in the direction substantially perpendicular to the work sheet feed direction, correcting the attitude of the work sheet and forming the toner image on the determined position on the toner image forming surface, and transferring the toner image on the toner image forming surface to a surface of the work sheet.

20 Claims, 8 Drawing Sheets

METHOD AND DEVICE FOR XEROGRAPHIC PRINTING

BACKGROUND OF THE INVENTION AND RELATED ART STATEMENT

The present invention relates to a method and device for xerographic printing, particularly to a xerographic printing method and device in which an attitude of a work sheet is corrected before the printing.

In conventional xerographic printing devices as disclosed by Publication of Japanese Laid-open Patent Application Shou-60-123873 and Publication of Japanese Patent Hei-2-28863, before a toner image is transferred to a surface of a work sheet, a leading side of the work sheet is fitted into a wedge-shaped groove which is formed between a pair of registration rollers and extends substantially perpendicularly to a work sheet feed direction, the direction of the leading side is corrected along the wedge-shaped groove, and subsequently a position of the leading side in a direction perpendicular to the work sheet feed direction is measured. In accordance with the measured position of the leading side, the pair of registration rollers is moved in the direction perpendicular to the work sheet feed direction to position the work sheet fed by the pair of registration rollers in relation to a position of a toner image forming drum in the direction perpendicular to the work sheet feed direction so that the toner image formed on a peripheral surface of the toner image forming drum fixed in the direction perpendicular to the work sheet feed direction can be transferred correctly to a predetermined position on the work sheet.

OBJECT AND SUMMARY OF THE INVENTION

An object of the present invention is to provide a xerographic printing method and device in which a time between correcting an attitude of a work sheet and transferring a toner image to the work sheet is short.

According to the present invention, a xerographic printing method comprises the steps of:

estimating, before an attitude of the work sheet is corrected, a position of work sheet which will be obtained in a direction substantially perpendicular to a work sheet feed direction after the attitude of the work sheet is corrected, determining, in accordance with the estimated position of work sheet, a position of a toner image to be formed on a toner image forming surface in the direction substantially perpendicular to the work sheet feed direction, correcting the attitude of the work sheet and forming the toner image on the determined position on the toner image forming surface, and transferring the toner image on the toner image forming surface to a surface of the work sheet.

According to the present invention, a xerographic printing device comprises, correcting means for correcting an attitude of a work sheet, estimating means for estimating, before the attitude of the work sheet is corrected by the correcting means, a position of work sheet which will be obtained in a direction substantially perpendicular to a work sheet feed direction after the attitude of the work sheet is corrected, a toner image forming surface on which a toner image to be transferred to a surface of the work sheet is formed, toner image forming means for forming the toner image on the toner image forming surface at a position adjusted in the direction substantially perpendicular to the work sheet feed direction in accordance with the estimated position of work sheet, and transferring means for transferring the toner image on the toner image forming surface onto the surface of the work sheet.

In the present invention, since, before the attitude of the work sheet is corrected, the position of work sheet which will be obtained in the direction substantially perpendicular to the work sheet feed direction after the attitude of the work sheet is completed to be corrected is estimated, the position at which the toner image will be formed on the toner image forming surface in the direction substantially perpendicular to the work sheet feed direction is determined in accordance with the estimated position of work sheet, the attitude of the work sheet is corrected and the toner image is formed on the determined position on the toner image forming surface, the toner image can be formed on the toner image forming surface with an adjustment of the position at which the toner image is formed on the toner image forming surface in the direction substantially perpendicular to the work sheet feed direction, while the attitude of the work sheet is corrected, and the toner image on the toner image forming surface can start to be transferred onto the surface of the work sheet immediately after the attitude of the work sheet has been corrected.

DETAILED DESCRIPTION OF PREFERRED EMBODIMENTS

Figure 1:
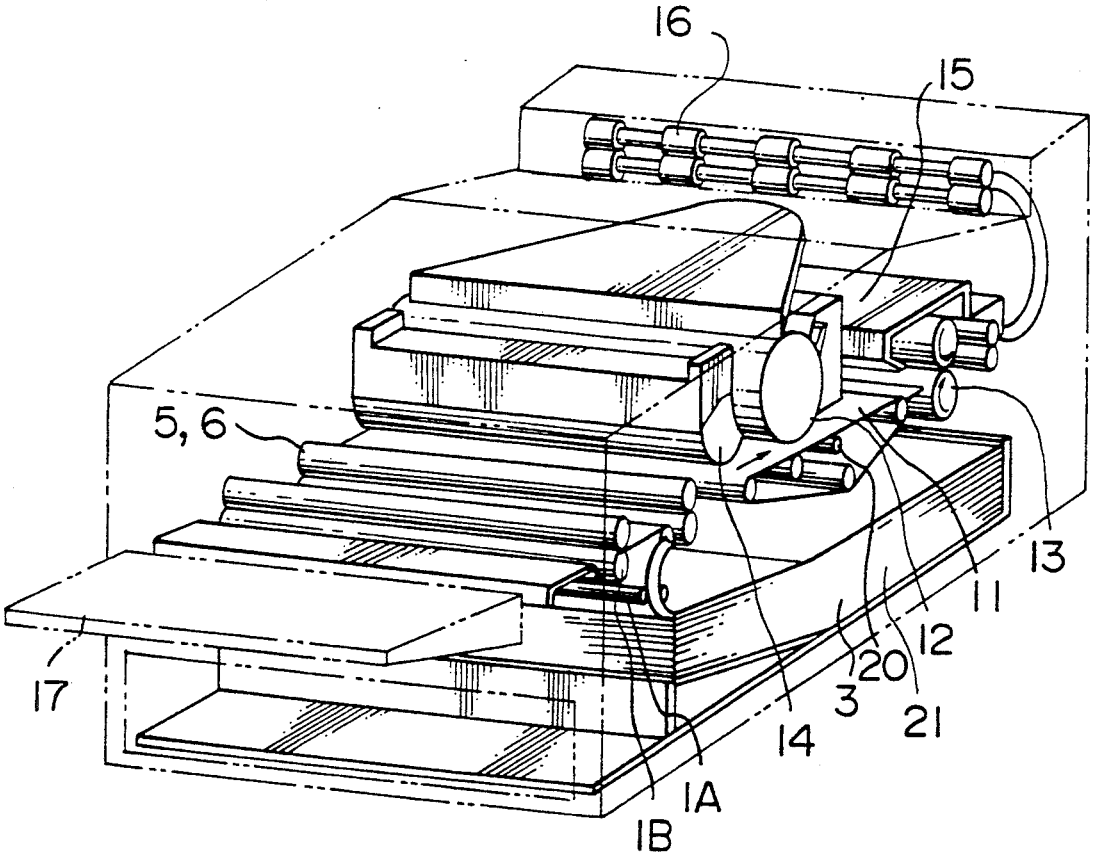
FIG. 1 is a schematic view showing a xerographic printing machine to which the present invention is applied.
Figure 2:
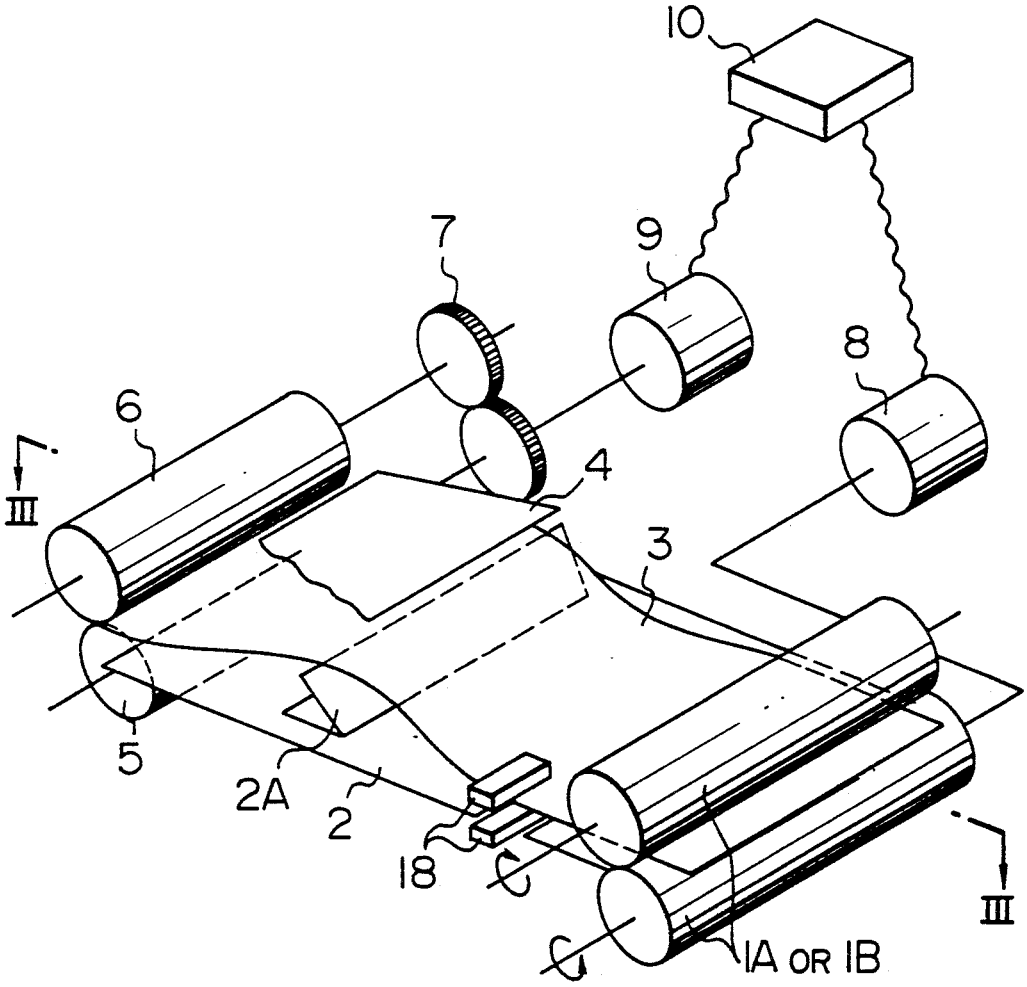
FIG. 2 is an oblique projection schematic view showing an embodiment of the present invention.
Figure 3:
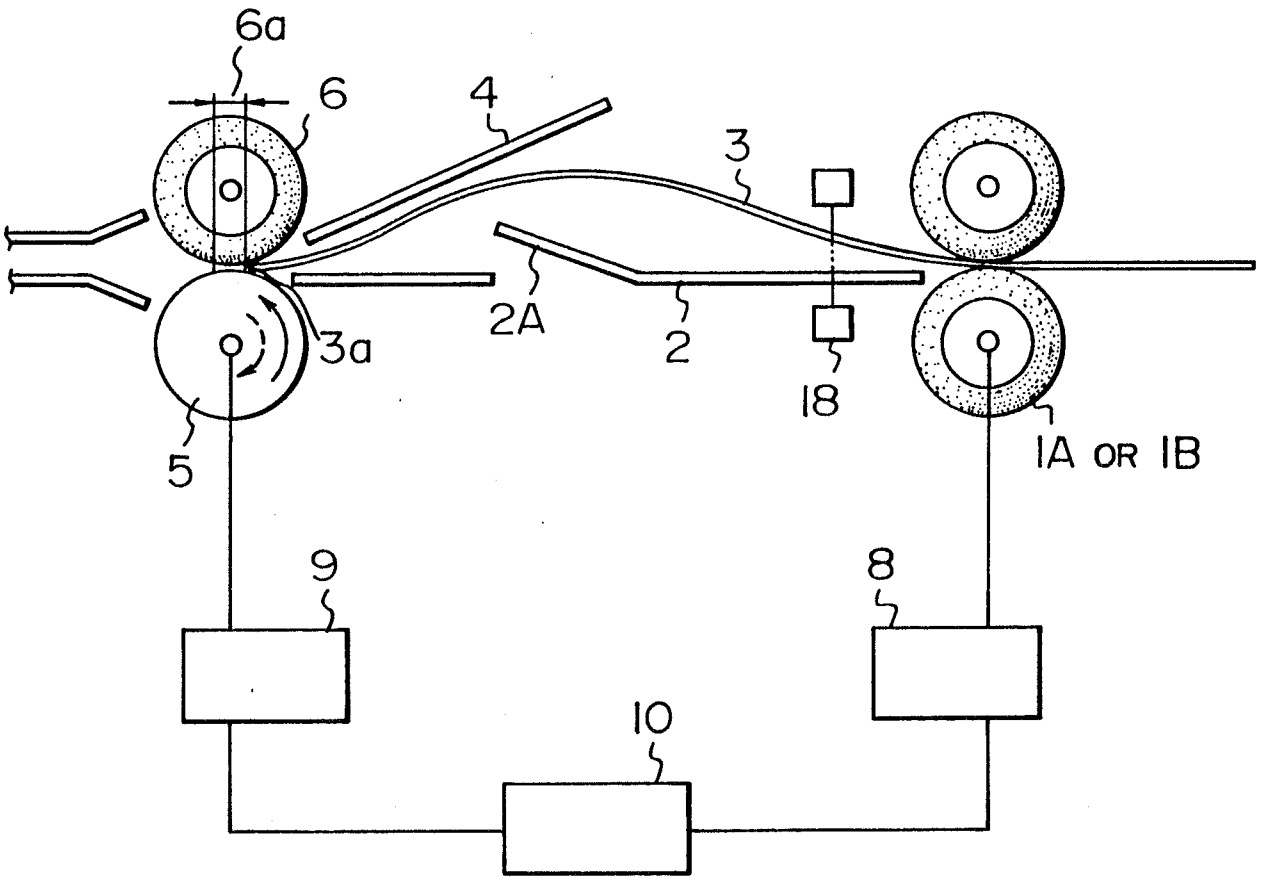
FIG. 3 is a schematic view taken along the line III—III in FIG. 2.

As shown in FIGS. 1 to 3, a work sheet 3 taken out mechanically from a work sheet supply portion 21 is fed by a pair of feed rollers 1A driven by a motor 8 controlled by a controller 10 or the work sheet 3 supplied manually from an inlet 17 is fed by a pair of feed rollers lB driven by the motor 8 controlled by the controller 10, toward a pair of registration rollers 5, 6 through a bent portion 2a of a guide 2 for forming an upwardly raised curvature of the work sheet 3 and through an upper guide 4 for guiding downwardly a leading side of the work sheet 3. An operation of the pair of registration rollers 5, 6 driven by a motor 9 is controlled by the controller 10 to make a direction of the leading side of the work sheet 3 parallel to along rotational axes of the registration rollers 5, 6 extending substantially perpendicularly to a work sheet feed direction substantially perpendicular to rotational axes of the feed rollers 1A or 1B.

A toner image forming surface is formed on an outer peripheral surface of a toner image forming drum 12 whose rotational axis is substantially perpendicular to the work sheet feed direction, and a toner electrified by an electrification device 14 is attached onto the toner image forming surface with a coulombic force between the electrified toner and the toner image forming drum 12. The electrification device 14 extending parallel to a rotational axis of the toner image forming drum 12 electrifies the toner in accordance with a rotation of the toner image forming drum 12 to form a desired toner image on the toner image forming surface. The work sheet 3 is fed and pressed against the toner image forming surface by a belt 3 and the pair of registration rollers 5, 6 with a feed speed of the work sheet 3 substantially equal to an outer peripheral rotational speed of the toner image forming drum 12 so that the toner image on the toner image forming surface is transferred onto the work sheet 3 by an electric field generated by an electric field generator 20 to attract the electrified toner to the work sheet 3. A rotational movement of the toner image on the toner image forming surface and a movement of the work sheet 3 by the belt 3 and the pair of registration rollers 5, 6 are synchronized so that the toner image on the toner image forming surface contacts with a desired position on the work sheet 3 in the work sheet feed direction. Subsequently, the toner image on the work sheet 3 is heated by a fixing device 13 to fix the toner image to the work sheet 3, and the work sheet 3 is discharged by a feed roller 16.

In order to make the direction of the leading side of the work sheet 3 parallel to the rotational axes of the registration rollers 5, 6 to correct an attitude of the work sheet 3 before the toner image is transferred to the work sheet 3, a leading end 3*a* of the work sheet 3 fed by the pair of feed rollers 1A or 1B contacts with a wedge-shaped groove defined between the rotationally stopped pair of registration rollers 5, 6 adjacently to a nip portion 6a extending substantially perpendicularly to the work sheet feed direction. When the upwardly raised curvature of the work sheet 3 guided by the bent portion 2*a* of the guide 2 is enlarged by a further feed of the work sheet 3 by the pair of the feed rollers 1A or 1B to separate from the bent portion 2*a*, a rigidity of the work sheet 3 for supporting the leading side between the leading side and a portion of work sheet clamped by the pair of the feed rollers 1A or 1B decreases and the leading side pressed forward from the clamped portion of work sheet can move freely so that the direction of the leading side including the leading end 3*a* is corrected along the wedge shaped groove adjacently to the nip portion 6*a* or is made substantially perpendicular to the work sheet feed direction.

When the direction of the leading side is corrected along the wedge shaped groove after the leading end 3*a* contacts with the wedge-shaped groove defined between the rotationally stopped pair of registration rollers 5, 6, the pair of registration rollers 5, 6 may be rotationally stopped or may rotate backward to urge the leading end 3*a* toward the feed rollers 1A or 1B. Alternatively, when the leading end 3*a* of the work sheet 3 fed by the pair of feed rollers 1A or 1B contacts with the wedge-shaped groove and subsequently the upwardly raised curvature of the work sheet 3 is enlarged, the pair of registration rollers 5, 6 may rotate backward to urge the leading end 3*a* toward the feed rollers 1A or 1B to correct the direction of the leading side along the wedge shaped groove or to make the direction of the leading side substantially perpendicular to the work sheet feed direction. Alternatively, after the leading side passes the nip portion 6*a* between the pair of registration rollers 5, 6 rotating forward to feed the work sheet 3 toward the toner image forming drum 12, the pair of registration rollers 5, 6 may rotate backward to urge the leading end 3*a* toward the feed rollers 1A or 1B to make the direction of the leading side along the wedge-shaped groove substantially perpendicular to the work sheet feed direction.

In the present invention, no matter what method is used to correct the attitude of the work sheet 3 or the direction of the leading side thereof, a post-correction position of work sheet which will be obtained after a completion of the correction of the attitude of the work sheet 3 in the direction substantially perpendicular to the work sheet feed direction is estimated before the completion of the correction of the attitude of the work sheet 3, a position for forming the toner image on the toner image forming surface in the direction substantially perpendicular to the work sheet feed direction is adjusted in accordance with the estimated position of work sheet, and the toner image is formed on the adjusted position of toner image forming surface which is appropriate for transferring the toner image on the toner image forming surface to a desired position of work sheet in the direction substantially perpendicular to the work sheet feed direction. Therefore, the toner image can start to be formed on the appropriately adjusted position of toner image forming surface, while the attitude of the work sheet 3 is corrected. According to a variation of the estimated position of the work sheet 3 relative to a datum point, the position for forming the toner image on the toner image forming surface is adjusted. A method for estimating the post-correction position of work sheet when the direction of the leading side is corrected by the rotationally stopped pair of registration rollers 5, 6 is different from a method for estimating the post-correction position of work sheet when the direction of the leading side is corrected by the pair of registration rollers 5, 6 rotated backward to urge the leading end 3*a* toward the feed rollers 1A or 1B.

Figure 4:
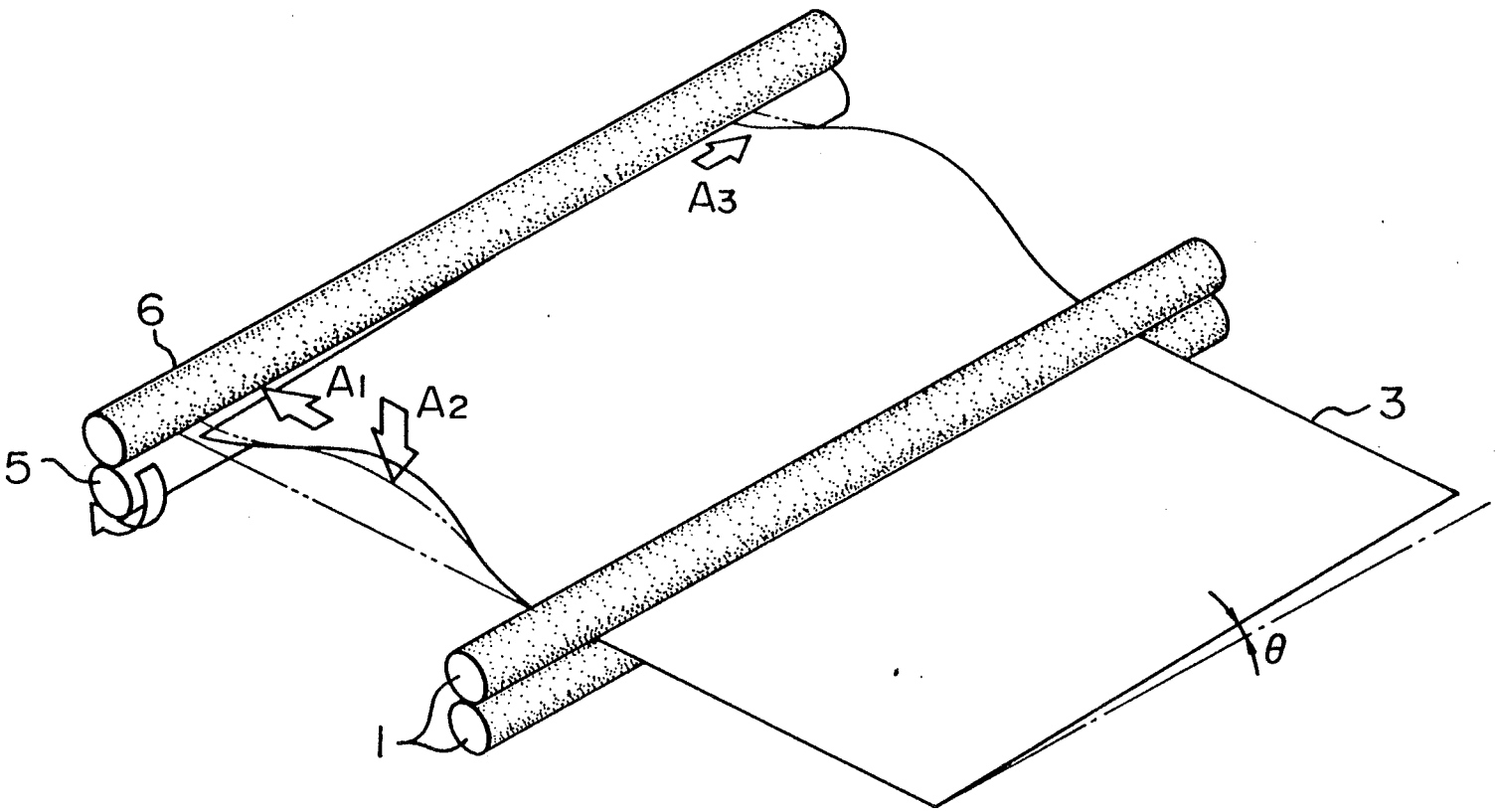
FIG. 4 is an oblique projection schematic view showing an action of work sheet on an attitude correcting operation thereof.

When the direction of the leading side is corrected by the pair of registration rollers 5, 6 rotated backward to urge the leading end 3*a* toward the feed rollers 1A or 1B, the post-correction position of work sheet is estimated as follows. As shown in FIG. 4, when the direction of the leading side is corrected by the pair of registration rollers 5, 6 rotated backward, the direction of the leading side which forms an undesirable angle relative to the direction substantially perpendicular to the work sheet feed direction and is denoted by a solid line is corrected by the decrease of rigidity of the work sheet 3 between the leading side and the portion of work sheet clamped by the pair of the feed rollers 1A or 1B, in a direction denoted by Al along the wedge shaped groove. In this time, a longitudinal side of work sheet extending substantially perpendicular to the leading side moves in a direction denoted by A3, and the surface of the work sheet 3 moves in a direction denoted by A2. An alternate long and dash line shows the work sheet 3 whose attitude does not need to be corrected or is not corrected with the leading side substantially perpendicular to the work sheet feed direction before the attitude correction of the work sheet 3. An alternate long and two dashes line shows the work sheet 3 whose undesirable attitude denoted by the solid line has been corrected.

Figure 5A:
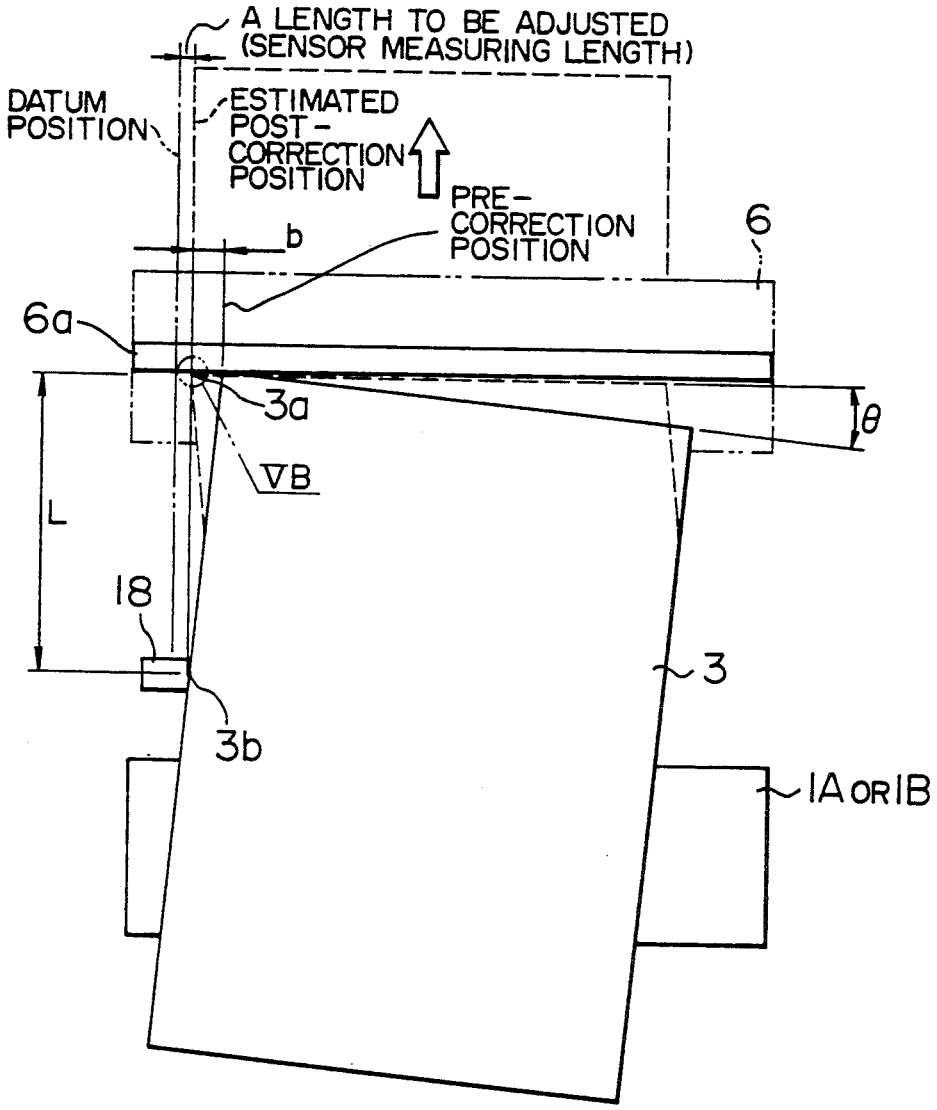
FIG. 5A is a schematic view showing a relation between a position of work sheet before the attitude correcting operation and an estimated position of work sheet which will be obtained after the attitude correcting operation and is estimated before the attitude correcting operation, which relation is obtained when a pair of registration rollers is rotated backward for the attitude correcting operation.
Figure 5B:
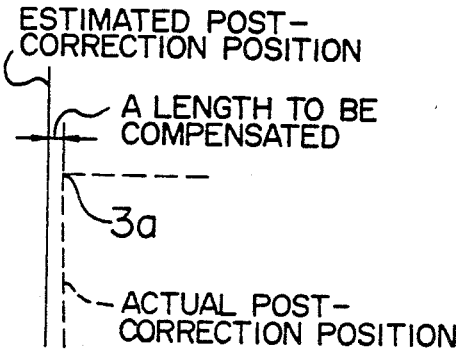
FIG. 5B is a schematic enlarged view of a part of FIG. 5A denoted by VB therein, showing a relation between the estimated position of work sheet and an actual position of work sheet after the attitude correcting operation.

As shown in FIGS. 5A and 5B, a sensor 18 measures a position of a point on the longitudinal side of work sheet in the direction substantially perpendicular to the work sheet feed direction, when or just before the leading end 3*a* of the work sheet 3 fed by the pair of feed rollers 1A or 1B has contacted with the wedge-shaped groove adjacently to the nip portion 6*a* between the registration rollers 5, 6. If a position of the sensor 18 in the work sheet feed direction is appropriately determined when the pair of registration rollers 5, 6 rotates backward after the leading end 3*a* contacts with the wedge-shaped groove, the sensor 18 can measure a position of a longitudinal side point 3*b* whose position in the direction substantially perpendicular to the work sheet feed direction is not changed by the work sheet attitude correction. That is, the leading end 3*a* rotates around the longitudinal side point 3*b* when the attitude of the work sheet 3 is corrected by the backward rotation of the registration rollers 5, 6.

According to an experimental result by the inventors, when a positional relation between the pair of registration rollers 5, 6 and the leading end 3*a* is set as described above, a distance between the pair of registration rollers 5, 6 and the pair of feed rollers 1A or 1B is 100 to 200 mm and a paper having a approximate thickness of 80 to 270 μm and a approximate width of 50 to 300 mm is used, the longitudinal side point 3*b* exists distantly from the leading end 3*a* by 30 to 50 mm on the longitudinal side in the work sheet feed direction. That is, a distance or length L between a position of the leading end 3*a* obtained when or just before the leading end 3*a* has contacted with the wedge-shaped groove and the sensor 18 is approximately 30 to 50 mm. In order to obtain the above described positional relation between the pair of registration rollers 5, 6 and the leading end 3*a*, the pair of feed rollers 1A or 1B rotates by a predetermined rotational degree for feeding the work sheet 3 by the length L after the leading end 3*a* has passed the sensor 18. In the direction substantially perpendicular to the work sheet feed direction, a position of the leading end 3*a* obtained after the attitude of the work sheet 3 is corrected is substantially the same as or can be deemed the same as that of the longitudinal side point 3*b* whose position in the direction substantially perpendicular to the work sheet feed direction is not changed by the work sheet attitude correction. If the position of the leading end 3*a* obtained after the attitude of the work sheet 3 is corrected is slightly different from that of the longitudinal side point 3*b* before the work sheet attitude correction or if the position of the longitudinal side point 3*b* before the work sheet attitude correction is slightly different from that of the longitudinal side point 3*b* after the work sheet attitude correction, that is, if an actual position of the leading end 3*a* obtained after the attitude of the work sheet 3 is corrected is slightly different from that of the longitudinal side point 3*b* obtained before the work sheet attitude correction as shown in FIG. 5B, the estimated position of the leading end 3*a* which will be obtained after the attitude of the work sheet 3 may be compensated by a predetermined difference between the actual position of the leading end 3*a* after the attitude of the work sheet 3 and the measured position of the longitudinal side point 3*b* before the attitude of the work sheet 3, which predetermined difference is determined on the basis of previous experiments.

Figure 6:
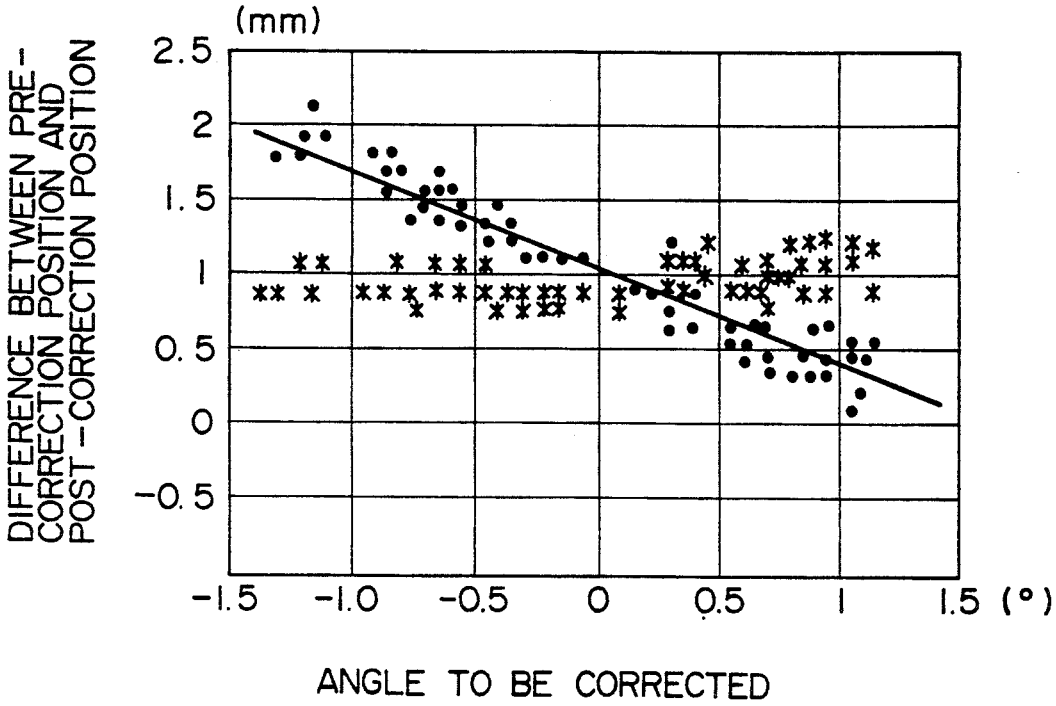
FIG. 6 is a diagram showing relations among an undesirable angle of a leading side of the work sheet before the attitude correcting operation, a difference between a position of work sheet leading side before the attitude correcting operation and a position of work sheet leading side after the attitude correcting operation in a direction substantially perpendicular to a work sheet feed direction, and a difference between the estimated position of work sheet and the actual position of work sheet after the attitude correcting operation in the direction substantially perpendicular to the work sheet feed direction.
Figure 7:
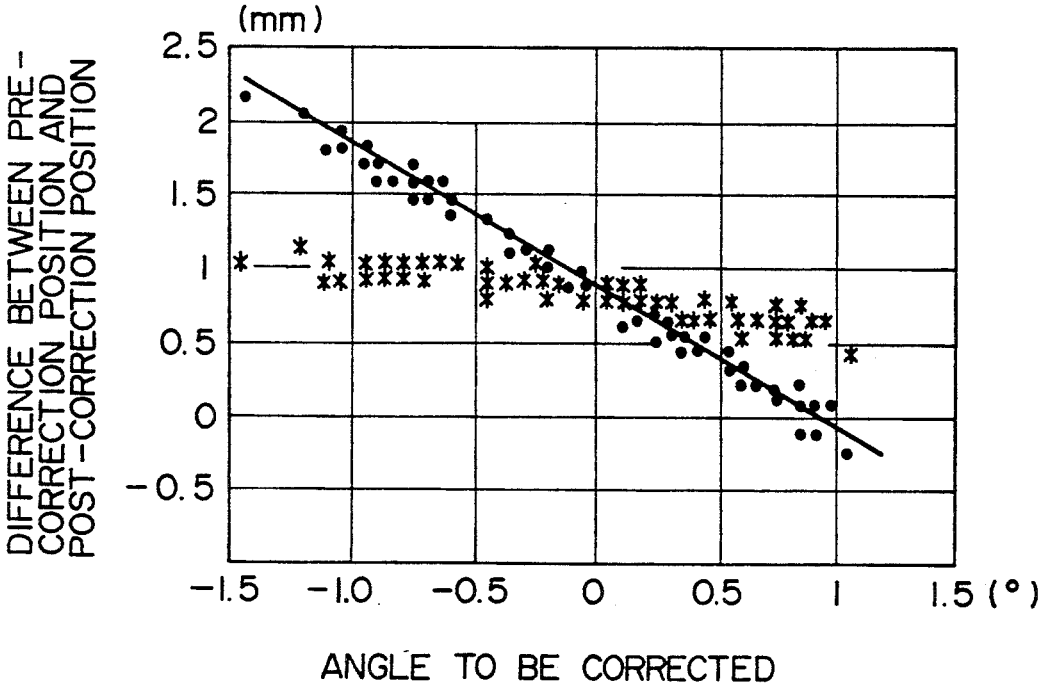
FIG. 7 is a diagram showing the other relations among an undesirable angle of a leading side of the work sheet before the attitude correcting operation, a difference between a position of work sheet leading side before the attitude correcting operation and a position of work sheet leading side after the attitude correcting operation in a direction substantially perpendicular to a work sheet feed direction, and a difference between the estimated position of work sheet and the actual position of work sheet after the attitude correcting operation in the direction substantially perpendicular to the work sheet feed direction.

In FIGS. 6 and 7, relations among an undesirable angle $\theta$ formed between the direction substantially perpendicular to the work sheet feed direction and the leading side of the work sheet 3 before the work sheet attitude correction as shown in FIG. 5, a difference between the position of the leading end 3*a* before the work sheet attitude correction and the position of the leading end 3*a* after the work sheet attitude correction in the direction substantially perpendicular to the work sheet feed direction, and a difference between the position of the longitudinal side point 3*b* before the work sheet attitude correction or the estimated position of the leading end 3*a* and the actual position of the leading end 3*a* after the work sheet attitude correction in the direction substantially perpendicular to the work sheet feed direction are shown. The relations in FIG. 6 are obtained when a paper sheet has a thickness of 90 μm, and the relations in FIG. 7 are obtained when a paper sheet has a thickness of 220 μm. The difference between the position of the leading end 3a before the work sheet attitude correction and the position of the leading end a after the work sheet attitude correction is denoted by "·" and the difference between the position of the longitudinal side point 3b before the work sheet attitude correction and the position of the longitudinal side point 3b after the work sheet attitude correction is denoted by "*".

As understood from FIGS. 6 and 7, the difference between the position of the leading end 3a before the work sheet attitude correction and the position of the leading end 3a after the work sheet attitude correction is substantially in proportion to the undesirable angle θ before the work sheet attitude correction, the difference between the position of the longitudinal side point 3b before the work sheet attitude correction or the estimated position of the leading end 3a and the actual position of the leading end 3a after the work sheet attitude correction is substantially constant and very small regardless of the undesirable angle θ. Since the difference between the position of the longitudinal side point 3b before the work sheet attitude correction and the actual position of the leading end 3a after the work sheet attitude correction is very small, the position of the longitudinal side point 3b before the work sheet attitude correction may be deemed to be the actual position of the leading end 3a after the work sheet attitude correction or the estimated position of the leading end 3a which will be obtained after the work sheet attitude correction. Further, the estimated position of the leading end 3a may be compensated by the difference between the position of the longitudinal side point 3b before the work sheet attitude correction and the actual position of the leading end 3a after the work sheet attitude correction, which difference is predetermined on the basis of the experimental results as shown in FIGS. 6 and 7. The compensation of the estimated position of the leading end 3a may be changed according to the thickness of the work sheet 3, because the relations shown in FIG. 6 is different from the relations shown in FIG. 7.

The position of the leading end 3a which will be obtained after the work sheet attitude correction can be estimated before the work sheet attitude correction, on the basis of the relations as shown in FIG. 6 or 7, the position of the leading end 3a before the work sheet attitude correction and the undesirable angel θ. That is, the position of the leading end 3a which will be obtained after the work sheet attitude correction can be estimated before the work sheet attitude correction, on the basis of the measured position of the leading end 3a before the work sheet attitude correction, the measured undesirable angle θ and the predetermined relations between the difference between the position of the leading end 3a before the work sheet attitude correction and the position of the leading end 3a after the work sheet attitude correction and the undesirable angle θ as shown in FIG. 6 or 7. That is, (the position of the leading end 3a which will be obtained after the work sheet attitude correction)=(the measured position of the leading end 3a before the work sheet attitude correction)−(the difference between the position of the leading end 3a before the work sheet attitude correction and the position of the leading end 3a after the work sheet attitude correction, which difference is determined on the basis of the measured undesirable angle θ and the predetermined relations between the difference between the position of the leading end 3a before the work sheet attitude correction and the position of the leading end 3a after the work sheet attitude correction and the undesirable angle θ as shown in FIG. 6 or 7).

Figure 9:
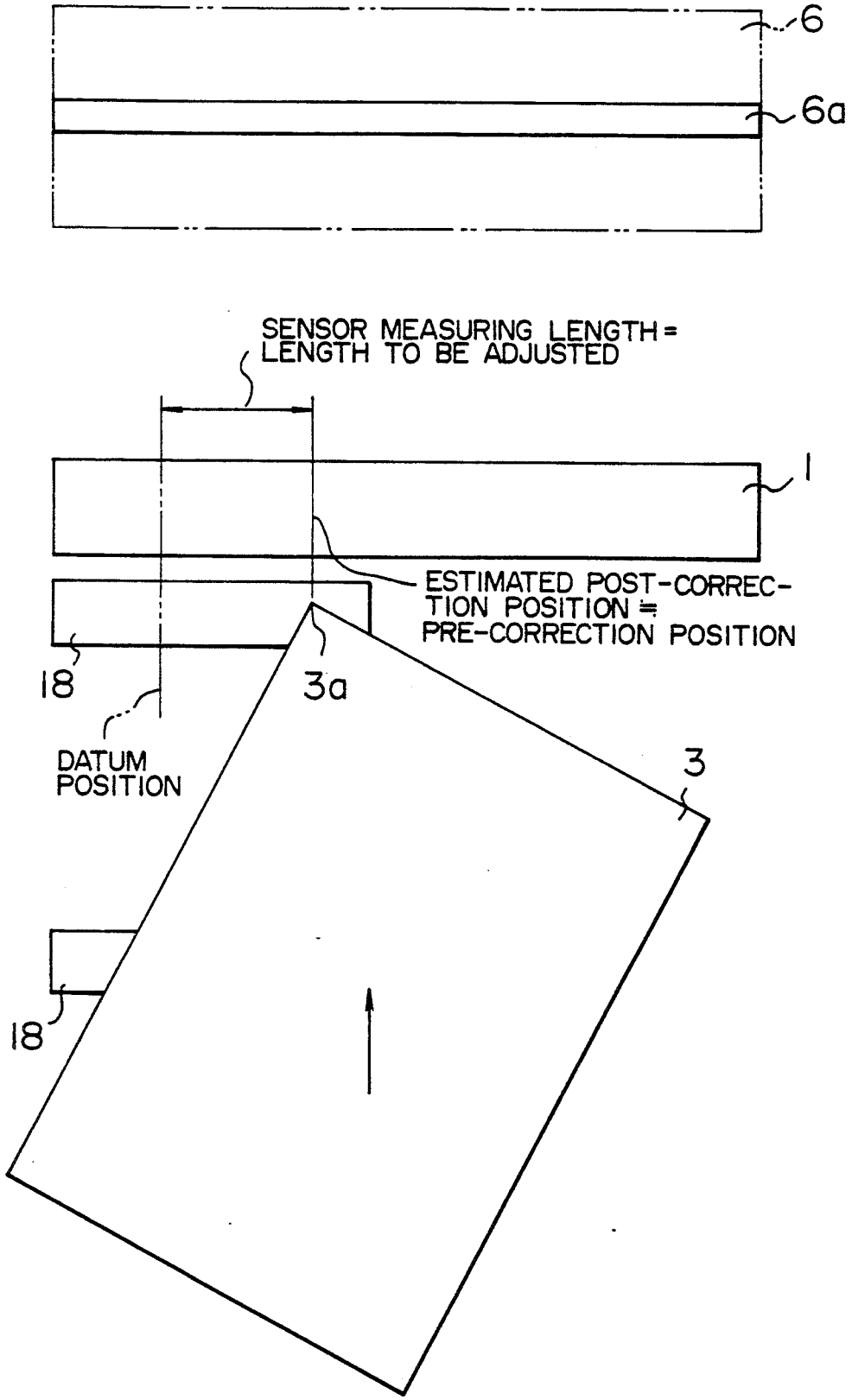
FIG. 9 is a shcematic view showing a relation between a position of work sheet before the attitude correcting operation and an estimated position of work sheet which will be obtained after the attitude correcting operation and is estimated before the attitude correcting operation, which relation is obtained when the pair of registration rollers is not rotated backward for the attitude correcting operation.

Since the position of the leading end 3a in the direction substantially perpendicular to the work sheet feed direction does not vary while the work sheet 3 is fed in the work sheet feed direction toward the pair of registration rollers 5, 6 by the pair of feed rollers 1A or 1B, the position of the leading end 3a before the work sheet attitude correction in the direction substantially perpendicular to the work sheet feed direction is measured by the sensor 18 when the leading end 3a passes on the sensor 18 which may be arranged between the pair of registration rollers 5, 6 and the pair of feed rollers 1A or 1B or may be arranged an upper stream side of the feed rollers 1A or 1B as shown in FIG. 9, regardless of a distance between the sensor 18 and the pair of registration rollers 5, 6. If the leading side of the work sheet 3 extends perpendicularly to the longitudinal side thereof, the undesirable angle θ can be determined on the basis of a length of the work sheet 3 fed on the sensor 18 in the work sheet feed direction by a rotation of the pair of feed rollers 1A or 1B and a variation of position of the longitudinal side measured in the direction substantially perpendicular to the work sheet feed direction by the sensor 18 while the length of the work sheet 3 passes on the sensor 18. That is, tan θ=(the variation of position of the longitudinal side measured by the sensor 18 while the length of the work sheet 3 passes on the sensor 18)/ (the length of the work sheet 3 passing on the sensor 18). Alternatively, the undesirable angle θ can be determined by a plurality of the sensors 18 distant from each other in the work sheet feed direction by a predetermined distance. That is, tan θ=(a difference between the positions of the longitudinal side of the work sheet 3 in the direction substantially perpendicular to the work sheet feed direction, which positions are measured simultaneously by the sensors 18, respectively)/(the predetermined distance between the sensors 18).

Figure 8:
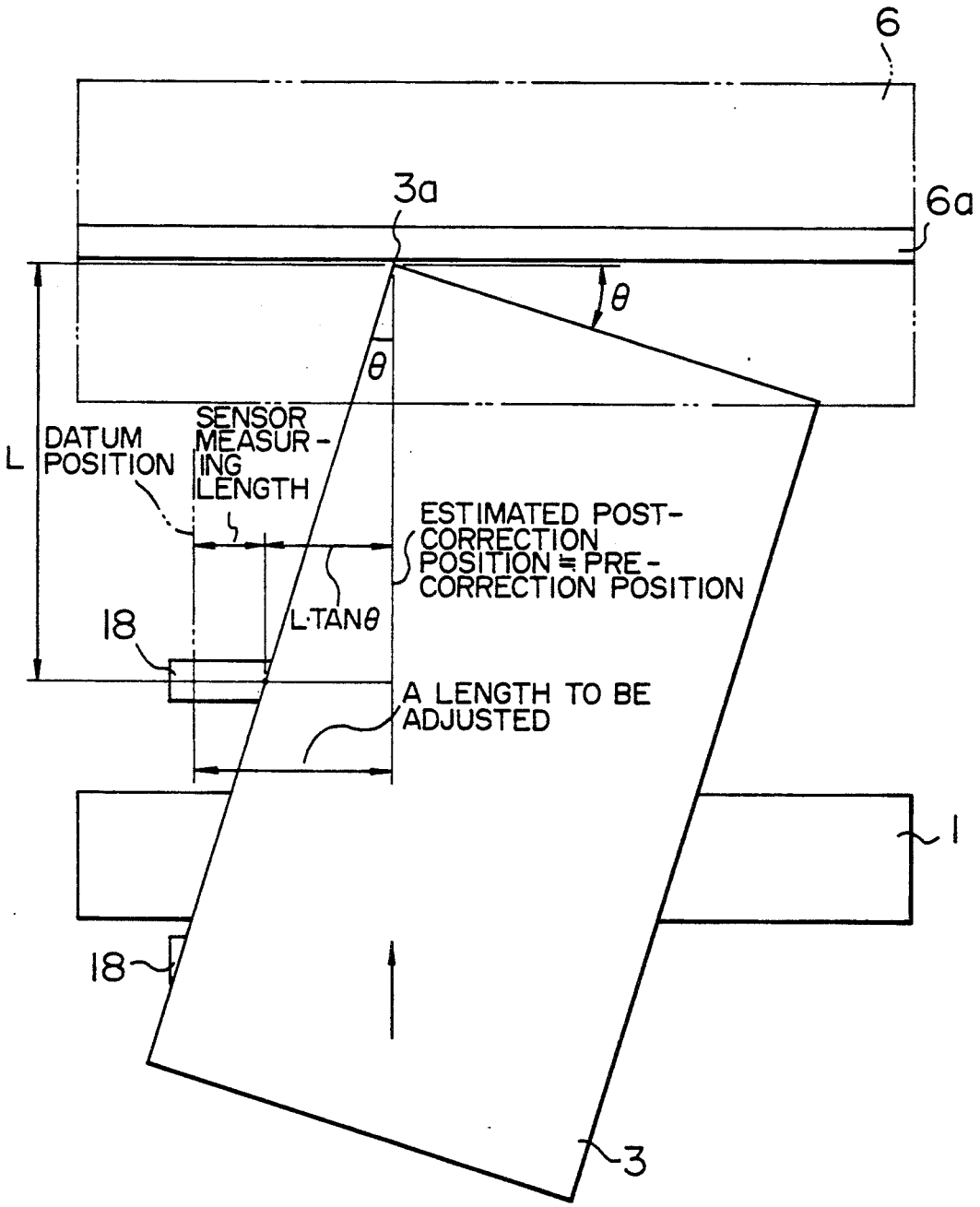
FIG. 8 is a schematic view showing a relation between a position of work sheet before the attitude correcting operation and an estimated position of work sheet which will be obtained after the attitude correcting operation and is estimated before the attitude correcting operation, which relation is obtained when the pair of registration rollers is not rotated backward for the attitude correcting operation.

If the pair of registration rollers 5, 6 does not rotate backward for the work sheet attitude correction and the leading side of the work sheet 3 is pressed against the wedge-shaped groove between the registration rollers 5, 6 for the work sheet attitude correction, the position of the leading end 3a before the work sheet attitude correction and the position of the leading end 3a before the work sheet attitude correction are not different from each other in the direction substantially perpendicular to the work sheet feed direction. As shown in FIG. 8, the position of the longitudinal side of the work sheet 3 in the direction substantially perpendicular to the work sheet feed direction is measured by the sensor 18 in relation to a datum position when or just before the leading end 3a of the work sheet 3 has contacted with the wedge-shaped groove between the registration rollers 5, 6, or just before the leading end 3a of the work sheet 3 starts to be pressed against the wedge-shaped groove. And the undesirable angle θ is determined by any of the above described methods. In this case, (an estimated length between the datum position and the leading end 3a, which length will be obtained after the attitude of the work sheet 3 is corrected or the direction of the leading side of the work sheet 3 is made substantially parallel to the work sheet feed direction)-

=(a distance between the datum position and the measured position of the longitudinal side of the work sheet 3)+(the distance L * tan $\theta$).

Alternatively, as shown in FIG. 9, since the position of the leading end 3*a* does not vary in the direction substantially perpendicular to the work sheet feed direction while the work sheet 3 is fed in the work sheet feed direction toward the registration rollers 5, 6 by the pair of feed rollers 1A or 1B, in the direction substantially perpendicular to the work sheet feed direction, the position of the leading end 3*a* obtained just before the work sheet attitude correction, that is, the position of the leading end 3*a* which will be obtained after the work sheet attitude correction when the pair of registration rollers 5, 6 does not rotate backward for the work sheet attitude correction is substantially the same as the position of the leading end 3*a* measured by the sensor 18 just when the leading end 3*a* passes on the sensor 18, regardless of an arrangement or distance of the sensor 18 in relation to the pair of registration rollers 5, 6 and the pair of feed rollers 1A or 1B.

What is claimed is:

1. A xerographic printing method comprising the steps of:

estimating, before an attitude of the work sheet is corrected, a position of work sheet which will be obtained in a direction substantially perpendicular to a work sheet feed direction after the attitude of the work sheet is corrected, determining, in accordance with the estimated position of work sheet, a position of a toner image to be formed on a toner image forming surface in the direction substantially perpendicular to the work sheet feed direction, correcting the attitude of the work sheet and forming the toner image on the determined position on the toner image forming surface, and transferring the toner image on the toner image forming surface to a surface of the work sheet.

2. A xerographic printing method according to claim 1, wherein a leading end included by a leading side of the work sheet is pressed against a surface and a frictional force for urging the leading end against the pressing of the leading end is applied to the leading end when the attitude of the work sheet is corrected.

3. A xerographic printing method according to claim 1, wherein a leading end included by a leading side of the work sheet is pressed against a surface and a frictional force for urging the leading end against the pressing of the leading end is not applied to the leading end when the attitude of the work sheet is corrected.

4. A xerographic printing method according to claim 2, wherein the position of work sheet which will be obtained in the direction substantially perpendicular to the work sheet feed direction after the attitude of the work sheet is corrected is estimated by measuring a position of a portion of work sheet in he direction substantially perpendicular to the work sheet feed direction before the attitude of the work sheet is corrected, and which portion of work sheet does not substantially move in the direction substantially perpendicular to the work sheet feed direction when the attitude of the work sheet is corrected.

5. A xerographic printing method according to claim 2, wherein the position of work sheet which will be obtained in the direction substantially perpendicular to the work sheet feed direction after the attitude of the work sheet is corrected is estimated by measuring a position of a portion of work sheet in he direction substantially perpendicular to the work sheet feed direction before the attitude of the work sheet is corrected, and which portion of work sheet moves by a small degree in the direction substantially perpendicular to the work sheet feed direction when the attitude of the work sheet is corrected.

6. A xerographic printing method according to claim 2, wherein the method further comprises the steps of:

measuring an angle between the leading side and the surface before the attitude of the work sheet is corrected, and measuring a position of the leading side in the direction substantially perpendicular to the work sheet feed direction before the attitude of the work sheet is corrected, the position of work sheet which will be obtained in the direction substantially perpendicular to the work sheet feed direction after the attitude of the work sheet is corrected is estimated from the measured angle and from the measured position of the leading side on the basis of a predetermined relation between the angle to be corrected between the leading side and the surface and a difference between the position of the leading side before the angle is corrected and the position of the leading side after the angle is corrected in the direction substantially perpendicular to the work sheet feed direction.

7. A xerographic printing method according to claim 5, wherein the estimated position of work sheet which will be obtained in the direction substantially perpendicular to the work sheet feed direction after the attitude of the work sheet is compensated by a predetermined degree.

8. A xerographic printing method according to claim 6, wherein a longitudinal side of the work sheet extends substantially perpendicularly to the leading side thereof, and the angle between the leading side and the surface is measured by measuring a variation of position of the longitudinal side of the work sheet in the direction substantially perpendicular to the work sheet feed direction at a place fixed in the work sheet feed direction when a length of the work sheet passes on the place and by calculating the angle from the variation of position of the longitudinal side and the length of the work sheet passing on the place.

9. A xerographic printing method according to claim 6, wherein a longitudinal side of the work sheet extends substantially perpendicularly to the leading side thereof, and the angle between the leading side and the surface is measured by measuring a difference between positions of at least two portions of the longitudinal side in the direction substantially perpendicular to the work sheet feed direction, which portions are distant from each other in the work sheet feed direction by a distance, and by calculating the angle from the difference between the positions in the direction substantially perpendicular to the work sheet feed direction and from the distance.

10. A xerographic printing method according to claim 3, wherein the position of work sheet which will be obtained in the direction substantially perpendicular to the work sheet feed direction after the attitude of the work sheet is corrected is estimated by measuring a position of the leading side in the direction substantially perpendicular to the work sheet feed direction before the attitude of the work sheet is corrected.

11. A xerographic printing method according to claim 10, wherein the position of work sheet which will be obtained in the direction substantially perpendicular to the work sheet feed direction after the attitude of the work sheet is corrected is estimated by measuring a position of the leading end in the direction substantially perpendicular to the work sheet feed direction before the attitude of the work sheet is corrected.

12. A xerographic printing method according to claim 10, wherein a longitudinal side of the work sheet extends substantially perpendicularly to the leading side thereof, the leading end is also included by the longitudinal side, the method further comprises the steps of measuring, in the direction substantially perpendicular to the work sheet feed direction, a position of a point of longitudinal side distant from the leading end by a distance in the work sheet feed direction before the attitude of the work sheet is corrected, and measuring an angle between the leading side and the surface before the attitude of the work sheet is corrected, and the position of work sheet which will be obtained in the direction substantially perpendicular to the work sheet feed direction after the attitude of the work sheet is corrected is calculated from the measured position of the point on the longitudinal side in the direction substantially perpendicular to the work sheet feed direction, the measured angle and the distance.

13. A xerographic printing device comprises, correcting means for correcting an attitude of a work sheet, estimating means for estimating, before the attitude of the work sheet is corrected by the correcting means, a position of work sheet which will be obtained in a direction substantially perpendicular to a work sheet feed direction after the attitude of the work sheet is corrected, a toner image forming surface on which a toner image to be transferred to a surface of the work sheet is formed, toner image forming means for forming the toner image on the toner image forming surface at a position adjusted in the direction substantially perpendicular to the work sheet feed direction in accordance with the estimated position of work sheet, and transferring means for transferring the toner image on the toner image forming surface onto the surface of the work sheet.

14. A xerographic printing device according to claim 13, wherein the correcting means presses a leading end included by a leading side of the work sheet against a surface and applies a frictional force for urging the leading end against the pressing of the leading end to the leading end, when the attitude of the work sheet is corrected.

15. A xerographic printing device according to claim 13, wherein the correcting means presses a leading end included by a leading side of the work sheet against a surface without applying a frictional force for urging the leading end against the pressing of the leading end to the leading end, when the attitude of the work sheet is corrected.

16. A xerographic printing device according to claim 14, wherein the estimating means estimates the position of work sheet which will be obtained in the direction substantially perpendicular to the work sheet feed direction after the attitude of the work sheet is corrected, by measuring a position of a portion of work sheet in the direction substantially perpendicular to the work sheet feed direction before the attitude of the work sheet is corrected, and which portion of work sheet does not substantially move in the direction substantially perpendicular to the work sheet feed direction when the attitude of the work sheet is corrected.

17. A xerographic printing device according to calim 14, wherein the estimating means estimates the position of work sheet which will be obtained in the direction substantially perpendicular to the work sheet feed direction after the attitude of the work sheet is corrected, by measuring a position of a portion of work sheet in the direction substantially perpendicular to the work sheet feed direction before the attitude of the work sheet is corrected, and which portion of work sheet moves by a small degree in the direction substantially perpendicular to the work sheet feed direction when the attitude of the work sheet is corrected.

18. A xerographic printing device according to claim 14, wherein the estimating means measures an angle between the leading side and the surface before the attitude of the work sheet is corrected, measures a position of the leading side in the direction substantially perpendicular to the work sheet feed direction before the attitude of the work sheet is corrected, and calculates the position of work sheet which will be obtained in the direction substantially perpendicular to the work sheet feed direction after the attitude of the work sheet is corrected from the measured angle and from the measured position of the leading side on the basis of a predetermined relation between the angle to be corrected between the leading side and the surface and a difference between the position of the leading side before the angle is corrected and the position of the leading side after the angle is corrected in the direction substantially perpendicular to the work sheet feed direction.

19. A xerographic printing device according to claim 15, wherein the estimating means estimates the position of work sheet which will be obtained in the direction substantially perpendicular to the work sheet feed direction after the attitude of the work sheet is corrected by measuring a position of the leading side in the direction substantially perpendicular to the work sheet feed direction before the attitude of the work sheet is corrected.

20. A xerographic printing device according to claim 15, wherein a longitudinal side of the work sheet extends substantially perpendicularly to the leading side thereof, the leading end is also included by the longitudinal side, the estimating means estimates the position of work sheet which will be obtained in the direction substantially perpendicular to the work sheet feed direction after the attitude of the work sheet is corrected by measuring, in the direction substantially perpendicular to the work sheet feed direction, a position of a point of longitudinal side distant from the leading end by a distance in the work sheet feed direction before the attitude of the work sheet is corrected, by measuring an angle between the leading side and the surface before the attitude of the work sheet is corrected, and by calculating the position of work sheet which will be obtained in the direction substantially perpendicular to the work sheet feed direction after the attitude of the work sheet is corrected from the measured position of the point on the longitudinal side in the direction substantially perpendicular to the work sheet feed direction, the measured angle and the distance.

* * * * *